United States Patent [19]

Kanno et al.

[11] Patent Number: 4,938,705

[45] Date of Patent: Jul. 3, 1990

[54] CONNECTION STRUCTURE OF HIGH-VOLTAGE WIRING FOR AUTOMOBILE ENGINE

[75] Inventors: Toshiaki Kanno; Seiichi Wakabayashi, both of Shizuoka, Japan

[73] Assignee: Yazaki Corporation, Tokyo, Japan

[21] Appl. No.: 193,700

[22] Filed: May 13, 1988

[30] Foreign Application Priority Data

May 18, 1987 [JP] Japan ..... 62-72884[U]

[51] Int. Cl.[5] ..... H01R 13/52; H01R 13/53

[52] U.S. Cl. ..... 439/125; 439/936; 439/130

[58] Field of Search ..... 439/519, 521, 522, 936, 439/278–282, 125–128, 130, 586, 184; 174/77 S, 34 SM; 123/143 C, 169 PA

[56] References Cited

U.S. PATENT DOCUMENTS

| | | | |
|---|---|---|---|
| T953,007 | 12/1976 | Tachick et al. | 439/184 |
| 2,458,121 | 1/1949 | Waldron | 174/35 SM X |
| 3,113,881 | 12/1963 | Spurgeon et al. | 439/199 X |
| 3,241,095 | 3/1966 | Phillips | 439/199 |
| 3,476,915 | 11/1969 | Rapsis | 174/77 S X |
| 3,542,986 | 11/1970 | Kotslei | 439/184 X |
| 3,646,250 | 2/1972 | Estes | 123/143 C X |
| 3,861,777 | 1/1975 | Clark | 439/519 X |

*Primary Examiner*—Eugene F. Desmond

*Attorney, Agent, or Firm*—Sughrue, Mion, Zinn, MacPeak & Seas

[57] ABSTRACT

A high-voltage wiring connection structure having first and second insulating members fitted with one another and protecting an electrical connection portion disposed within at least one of the first and second insulating members. A layer of a soft elastic silicone resin is provided on a surface of at least the two insulating members in contact with a mating surface of the other of the insulating members. An improved sealing effect, with reduced arcing and improved reliability, is thereby attained.

6 Claims, 2 Drawing Sheets

CONNECTION STRUCTURE OF HIGH-VOLTAGE WIRING FOR AUTOMOBILE ENGINE

BACKGROUND OF THE INVENTION

The present invention relates to an improved insulation structure for a connection portion of an ignition device for an automotive vehicle.

In an ignition device for a car engine, generally, for example, as shown in FIG. 1, a high voltage generated in an ignition coil a is applied to a distributor c through a coil wire b so as to be distributed to sparkplugs e fitted to respective cylinders through corresponding plug wires d.

Further, a system in which a voltage is applied to each sparkplug e without passing through a distributor has been employed.

However, in high voltage wiring for an automobile, rainwater or the like sometimes may cause the wiring to become wet, thereby permeating connection portions thereof. Also, grounded members or the like may approach each other. In either case, a flashover fault may be caused, which can result in a dangerous fire. Such a phenomenon can also cause abnormal overheating in a catalytic converter for exhaust processing or cause the engine stopping or starting trouble. Moreover, resulting energy losses can cause ignition failure.

SUMMARY OF THE INVENTION

It is therefore an object of the present invention to provide a connection structure for high-voltage wiring in which the foregoing disadvantages are eliminated and which attains a high reliability.

In order to achieve the objects described above, according to the present invention, the connection structure of high-voltage wiring for an automobile engine is arranged such that insulating portions surrounding respective interconnection portions between terminals of high-voltage wiring are disposed in close contact with each other through a soft elastic silicone resin layer.

According to the present invention, it is preferable to previously provide the silicone resin layer on a surface where the insulating portions surrounding the respective terminal portions of the high-voltage wires to be connected to each other come into contact with each other. The silicone resin layer may be provided on each or either one of the high-voltage wires.

In the thus-arranged connection structure according to the present invention, the gap between the contacting surfaces of the respective insulating portions is tightly sealed by the elasticity of the silicone resin layer, the permeation of water or the like is prevented by the water repellency of the silicone resin, and salt, dust, or the like, cannot easily adhere to the connection structure. Accordingly, even if the connection structure is splashed with water, no leakage fault, flashover fault, or the like will occur, and even if a leak should occur, the connection structure is very resistant to damage by arcing and no tracking is caused.

DESCRIPTION OF THE PREFERRED EMBODIMENTS

Figure 1:
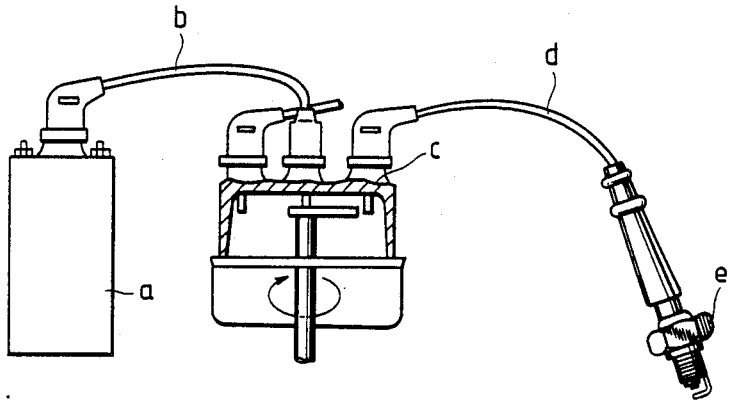
FIG. 1 PRIOR ART
FIG. 1 is a partially cut-away side view for explaining an example of conventional automobile engine high-voltage wiring.

Referring to the drawings, preferred embodiments of a high-voltage wiring connection structure according to the present invention will be described hereunder.

Figure 2A:
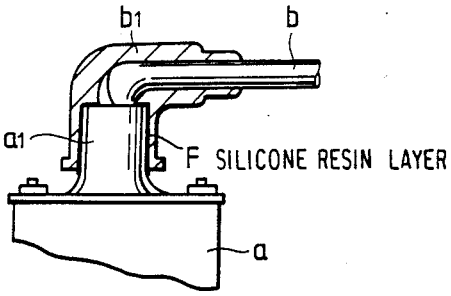
FIGS. 2A to 2C are sectional views illustrating various preferred embodiments of an automobile high-voltage wiring connection structure according to the present invention.

FIG. 2A shows an embodiment in which a layer F of silicone resin (for example, the silicone resin sold under the tradename "SYLGARD") is provided on a surface of a tower portion $a_1$ of an ignition coil a, and a coil cap $b_1$ of a coil wire b is fitted on the layer F.

Figure 2C:
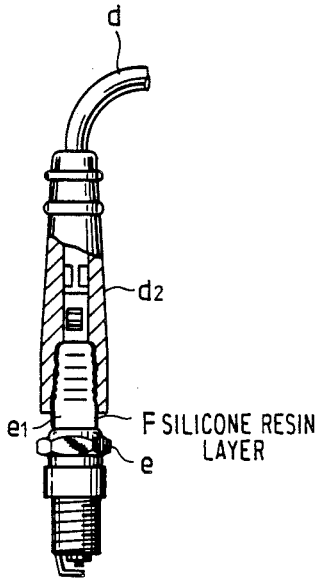
Figure 2B:
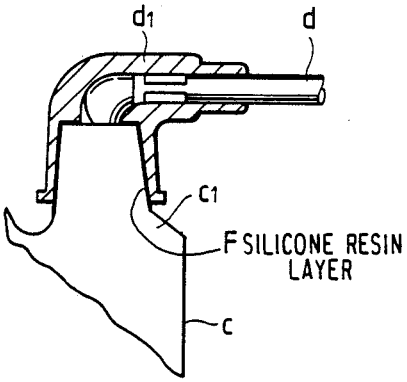

FIG. 2B shows another embodiment in which a silicone resin layer F similar to that of the above-described embodiment is provided on a surface of a tower portion $c_1$ of a distributor c, and a distributor cap $d_1$ of an ignition wire d is fitted on the layer F.

FIG. 2C shows an embodiment in which a silicon resin layer F similar to those of the above embodiments is provided on an insulator portion $e_1$ of a sparkplug e, and a plug cap $d_2$ of an ignition wire d is fitted on the layer F.

Figure 3A:
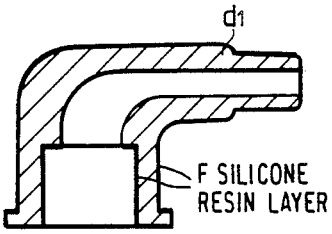
FIGS. 3A and 3B are sectional views illustrating other embodiments of an end cap of a wire used in an automobile engine.
Figure 3B:
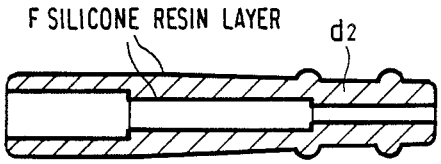

Further, FIG. 3A shows an embodiment in which inner and outer surfaces of a distributor cap $d_1$ are coated with silicone resin F through dip coating to thereby form a coating layer, and FIG. 3B shows another embodiment in which inner and outer surfaces of a plug cap $d_2$ are coated with silicone resin F, similarly to the embodiment of FIG. 3A.

Such a silicone resin layer provided on the surface of the cap portion of a high-voltage connection structure is soft and elastic. Hence, when the cap portion is fitted on the tower portion, insulator portion, or the like, the layer not only fits the surface of the cap portion and sticks tightly to it, but repels water well and prevents the permeation of water or the like.

The automotive high-voltage wiring connection structure according to the present invention thus provides an improved waterproofing property at connection portions, the electrical insulation property is little lowered, and reliability is improved.

What is claimed is:

1. In a vehicle ignition high-voltage wiring connection structure of the type having first and second insulating members fitted with one another and protecting an electrical connection portion disposed within at least one of said first and second insulating members, the improvement comprising a layer of a soft elastic silicone resin provided on a surface of at least said first insulating member in contact with a mating surface of said second insulating member.

2. The high-voltage connection structure of claim 1, wherein said first insulating member comprises a tower portion of an ignition coil and said second insulating member comprises a coil cap of a coil wire.

3. The high-voltage connection structure of claim 1, wherein said first insulating member comprises a tower portion of a distributor and said second insulating member comprises a distributor cap of an ignition wire.

4. The high-voltage connection structure of claim 3, wherein both inner and outer surfaces of said distributor cap are coated with a layer of said silicone resin.

5. The high-voltage connection structure of claim 1, wherein said first insulating member comprises an insulator portion of a sparkplug and said second insulating member comprises a plug cap of an ignition wire.

6. The high-voltage connection structure of claim 5, wherein both inner and outer surfaces of said plug cap are coated with a layer of said silicone resin.

* * * * *